United States Patent [19]

Long et al.

[11] Patent Number: 5,012,785

[45] Date of Patent: May 7, 1991

[54] FUEL INJECTION DELIVERY VALVE WITH REVERSE FLOW VENTING

[75] Inventors: David L. Long, Mount Clemens; Mark A. Mitchell, Dryden; David P. Sczomak, Troy, all of Mich.

[73] Assignee: General Motors Corporation, Detroit, Mich.

[21] Appl. No.: 372,596

[22] Filed: Jun. 28, 1989

[51] Int. Cl.[5] ..... F02M 39/00

[52] U.S. Cl. ..... 123/467; 123/506; 123/450; 417/462; 137/102

[58] Field of Search ..... 123/506, 467, 446, 450, 123/299-300; 137/625.2, 102; 417/462

[56] References Cited

U.S. PATENT DOCUMENTS

| | | | |
|---|---|---|---|
| 2,247,421 | 7/1941 | Tabb | 123/467 |
| 3,023,705 | 3/1962 | Heiser | 123/506 |
| 3,347,255 | 10/1967 | Williams | 137/102 |
| 3,359,574 | 9/1967 | Erb | 137/102 |
| 3,387,597 | 6/1968 | Wirsching | 123/506 |
| 3,394,891 | 7/1968 | Voit | 123/299 |
| 3,734,258 | 5/1973 | Roob | 137/102 |
| 3,742,926 | 7/1973 | Kemp | 123/467 |
| 3,752,138 | 8/1973 | Gaines | 123/450 |
| 3,827,451 | 8/1974 | Roob | 137/102 |
| 4,232,644 | 11/1980 | Potter | 123/450 |
| 4,289,098 | 9/1981 | Norberg | 123/460 |
| 4,389,987 | 6/1983 | Fränkle | 123/462 |
| 4,453,896 | 6/1984 | Vilardo | 123/450 |
| 4,539,956 | 9/1985 | Hengel | 123/357 |
| 4,633,836 | 1/1987 | Fraupel | 123/467 |
| 4,651,779 | 3/1987 | Filippi | 123/506 |

OTHER PUBLICATIONS

"DM" Pump for Rugged Applications, Brochure on Roosa Master Pump from Stanadyne, SAE 790,899, Hess et al., particularly FIGS. 1, 18, and 20.

*Primary Examiner*—Carl Stuart Miller
*Attorney, Agent, or Firm*—Karl F. Barr, Jr.

[57] ABSTRACT

Fuel delivery valving operatively mounted in an axially extending center bore of a high pressure pump rotor. The valve axially shifts between an open position in which a charge of fuel generated by the pump is transmitted as a pressure wave to a fuel injector nozzle and a closed position in which the pump charging chamber is sealed from the injection line and the injection line is vented to low pressure so that secondary pressure waves reflecting from the injector nozzle will be routed to the low pressure line for dissipation therein rather than rebounding from the delivery valve. This improves engine operation efficiency and eliminates seocndary injection of fuel by the injector nozzle and high hydrocarbon and smoke emissions. One embodiment has a fuel delivery valve operatively mounted in each discharge fitting of a hydraulic head assembly of the fuel injection pump.

3 Claims, 3 Drawing Sheets

FUEL INJECTION DELIVERY VALVE WITH REVERSE FLOW VENTING

TECHNICAL FIELD

This invention relates to fuel injection for internal combustion engines and more particularly, to a delivery valve for a pumping system for directing high pressure fuel to a combustion chamber through an injector nozzle and for routing reverse flow pressure waves of fuel reflecting from the nozzle to a low pressure area to reduce or eliminate secondary injection in the system.

BACKGROUND OF THE INVENTION

Prior to the present invention, fuel injector pumping systems for internal combustion engines have incorporated a delivery valve in the passages between a high pressure pump and the injector nozzles for the combustion chambers to serve as a one-way check valve to seal the pumping chamber from the injector lines while it is being charged with fuel and to control residual line pressure by providing volume unloading. Such valving often incorporates a snubber valve to control secondary injection of fuel through the nozzle and cavitation erosion of the high pressure system by attenuating reflected pressure waves. This is accomplished when the snubber valve closes at the termination of pumping by the pressure drop in the injection line. The retraction velocity and negative pressure wave reflected from the nozzle are reduced by the snubber valve restriction. With this partial pressure wave reduction, secondary waves reflected from the delivery valve to the nozzle are reduced to thereby reduce secondary injection of fuel into the associated combustion chamber. With secondary injection reduced, fuel injection and engine operating efficiency are enhanced to meet higher standards for even greater improvement in engine operating efficiency with reduced pollutants such as smoke and hydrocarbons.

SUMMARY OF THE INVENTION

The present invention further provides new and improved delivery valving featuring automatic reverse flow venting. The vent opens when the valve seals the pumping chamber so that the secondary waves reflected from the injector nozzle are substantially eliminated by routing them into low pressure areas where they are dissipated instead of rebounding back to the nozzle. Accordingly, with this invention secondary injections and poor engine performance with high emissions of hydrocarbons and smoke are eliminated or sharply reduced. Since this invention effectively eliminates secondary fuel injection from secondary pressure waves, snubber valves may be eliminated in some fuel injector systems if not required for other operations.

It is an object of this invention to provide a new and improved delivery valve for fuel injection with provision for reverse flow venting which routes reflected pressure waves of fuel reflecting from the injector nozzle through the delivery valve element into low pressure areas for dissipation therein.

Another object of this invention is to provide a new and improved delivery valve for use in a fuel injector pumping system which eliminates the need for snubber valves by eliminating secondary injections by routing reflected pressure waves of fuel through the delivery valve into a low pressure area for dissipation therein.

These and other features, objects and advantages of this invention will become more apparent from the following detailed description and drawing in which:

DETAILED DESCRIPTION OF THE DRAWINGS

Figure 1:
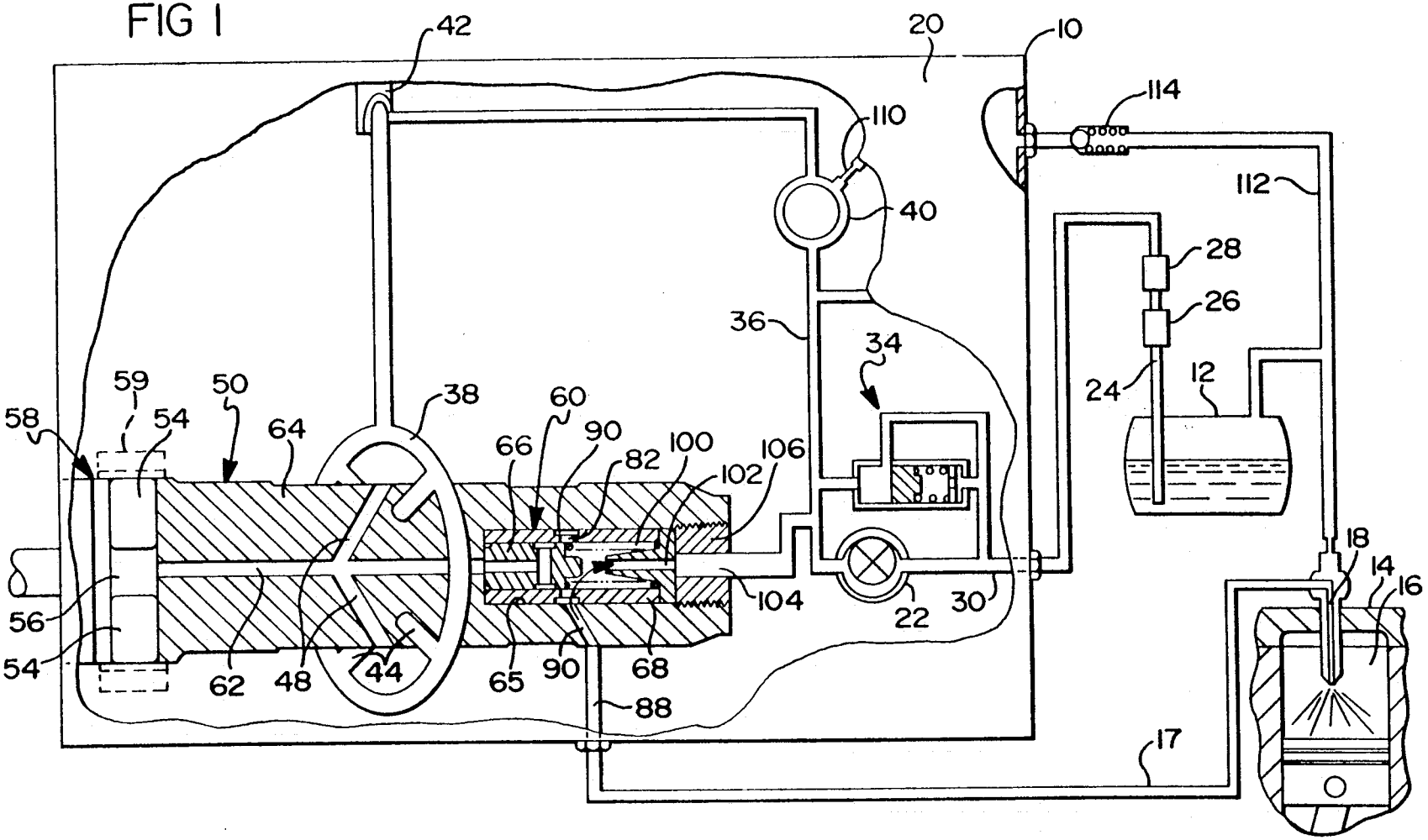
FIG. 1 is a schematic diagram of a portion of a fuel flow system of a distributor pump for a fuel injected internal combustion engine.

Turning now in greater detail to the drawings, there is diagrammatically shown in FIG. 1 a portion of a distributor pump 10 for pumping and distributing charges or pulses of fuel from a fuel tank 12 to the combustion chambers of an internal combustion engine 14, one of which is chamber 16 fed through a high pressure fuel injector line 17 and nozzle 18.

The distributor pump 10 has a housing 20 enclosing a governor (not shown) and other components including a vane type transfer pump 22 driven by the engine that pumps fuel at low pressure from fuel tank 12 through line 24 having water separator 26 and fuel filter 28 therein and through the internal intake passage 30 to a transfer pump intake. The pump 22 has pumping output volume and pressure controlled by pressure regulator 34 hydraulically connected in parallel with the pump. The pump 22 has a discharge port that connects to transfer passage 36 that feeds into an annular charging passage 38 through a circular head passage 40 and a governor controlled metering valve 42.

The charging passage 38 has arcuately spaced and inwardly extending delivery ports 44 that are fixed for registering with the inlet passages 48 of a rotatable engine driven fuel distributor rotor 50 so that a pair of opposing rotor mounted pumping plungers 54, of a cam operated, high pressure pump 58 can pump high pressure pulses of fuel from pumping chamber 56 into the system.

The plungers move radially outwardly in their associated bores within the rotor a distance proportional to the amount of fuel required for injection on the following stroke. At engine idle, the metering valve 42 is highly restrictive and a small quantity is admitted into the pumping chamber 56 so that the plungers move out a proportionally short distance. When the engine is operating at full load, the metering valve fully opens and the plungers are forced to their outermost position. These pumping plungers are stroked inwardly by a cam ring 59 when the rotor is driven to pump pulses of high pressure fuel to a delivery valve assembly 60 by way of an axial passage 62 in the shank 64 of the rotor.

Figure 2:
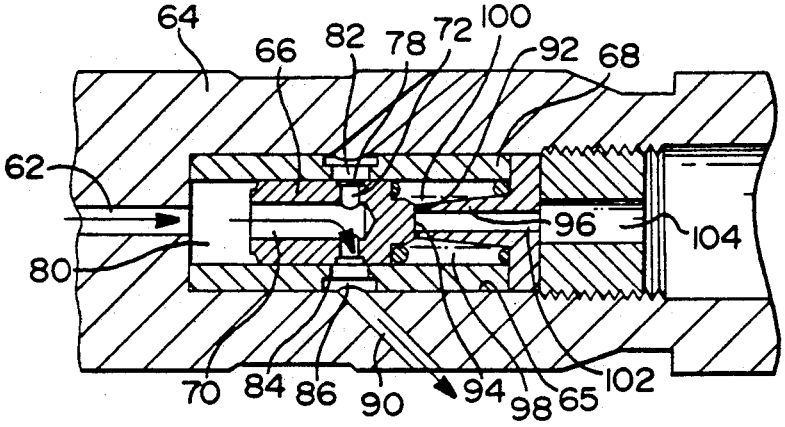
FIG. 2 is an enlarged view of the delivery valve of the fuel flow system of FIG. 1 showing the delivery valve element in a shifted position.

The delivery valve assembly is operatively mounted in an axial bore 65 also provided in the pump rotor shank 64. As shown in FIGS. 1 and 2, the delivery valve assembly 60 has a valve element 66 mounted for linear shifting movement within an associated cylindrical sleeve 68 that has an outer diameter sized to fit within the bore 65. As best shown in FIG. 2, the valve element 66, generally cylindrical in shape, has a centralized axially drilled bore 70, the blind end of which communicates with a diametral cross bore 72, that extends through the cylindrical valve element to terminate in annular fuel feed groove 78. The entrance end of the blind bore 70 communicates with a variable volume end chamber 80 formed by the valve element 66 and the sleeve 68, and communicates with the pumping chamber 56 by axial passage 62.

The cylindrical sleeve 68 has radial ports 82 extending through the wall thereof which feed into a discharge annulus 84. The ports 82 of the sleeve register with ports 78 of the cross bore of the valve element 66 when shifted into the FIG. 2 position so that pulses of high pressure fuel can be pumped from the high pressure pump 58 through the valve element via bores 70 and 72 to a port 86 of a fuel feed passage 90 that is hydraulically connected via passage 88 to a high pressure fuel injection line 17 that has a terminal end connected into the fuel injector nozzle 18.

The FIG. 2 position of the valve element 66 is established by the force from pulses of high pressure fuel that lift the valve element so that a contact end 92 thereof engages the axially extended end of a lift stop 96 mounted in the end of the sleeve 68. The end 94 of the lift stop extends internally into the sleeve 68 as best shown in FIG. 2 and provides a seat for a helical spring 98 that is in a spring pocket to exert a spring force on the valve element 66 urging it toward the seated FIG. 1 position. In this position, any reflected wave from the nozzle 18 through the line 17 and passage 88 is routed into the discharge annulus 84 and through radial ports 82 into chamber 100. From chamber 100, the reflected wave routes through a central passage 102 in the projecting stop 94 and into a central passage 104 in plug 106. From passage 104, the reflected pressure wave is routed by passage to a low pressure line.

After the transfer pump 22 has delivered sufficient fuel to the pumping chamber 56, as determined by the position of the metering valve 42 and the rotor has moved out of registry with the associated radial port, the pumping plungers are cammed inwardly so that a pulse of high pressure fluid physically lifts the delivery valve off of its seat, shown in FIG. 1, to the injection position, shown in FIG. 2, against the force of return spring 98. This pulse of pressure is routed by the axial and cross bores of valve element 66 through the sleeve porting into rotor passage 90 and into the fuel feed passage 88. From feed passage 88, the pulse routes through the injection line 17 as a high velocity pressure wave to the nozzle 18. Because of the restriction provided by the nozzle 18, reflects from the nozzle as a secondary pressure wave that travels at high velocity to the discharge valve 60 which has moved to the closed position of FIG. 1. Under these valve conditions, the wave passes through chamber 100, the passages 102, 104 and 106 to a low pressure area or passage such a low pressure passage 36 connecting the transfer pump to the charging passage 38 where this wave energy is dissipated. Instead of routing to the passage 36, the secondary wave could be readily transmitted to transfer pump inlet passage 30 or to the housing 20 which is supplied with low pressure fuel from pump 22 through restricted line 110. Line 112 with housing pressure regulator valve 114 therein connects the housing 20 to the tank 12 and the injector nozzle 18.

Moreover, when the valve element 66 moves toward its FIG. 1 position, a small retraction volume of fuel is removed from spring chamber 100, generating a negative pressure wave.

This invention accordingly substantially eliminates the reflection of secondary and subsequent pressure waves from the delivery valve to the nozzle, and the adverse effects thereof. For example, a secondary wave reflecting at high velocity from the valve would enter the nozzle late causing secondary fuel injection that would not be completely burned resulting in the increased emission of hydrocarbons and smoke.

Figure 3:
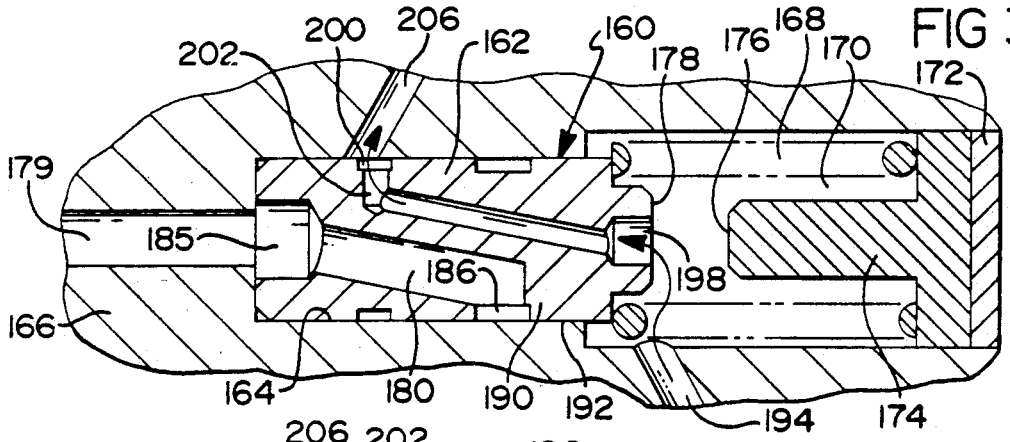
FIGS. 3, 3*a* and 3*b* are cross sectional views of a delivery valve similar to that of FIG. 2 showing another preferred embodiment of the invention in various operational positions.
Figure 3A:
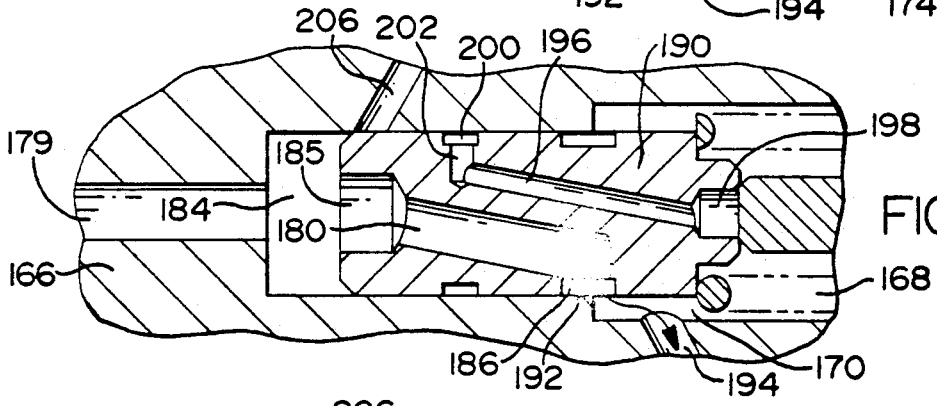
Figure 3B:
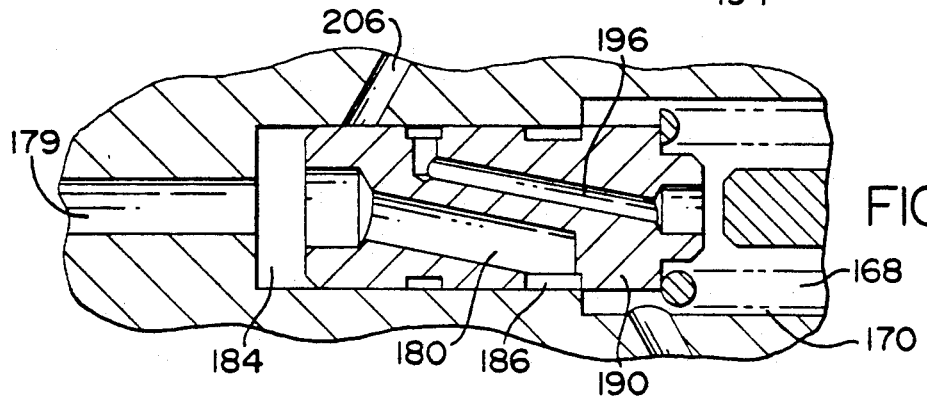

In the embodiment of FIGS. 3, 3A and 3B there is a fuel delivery and reverse flow venting valve 160 corresponding to valve assembly 60 of the previous embodiment of FIGS. 1 and 2 that has a generally cylindrical valve element 162 mounted for linear shifting movement in a bore 164 provided in the cylindrical shank 166 of a rotor of a high pressure fuel pump such as pump 58 of the previous embodiment. The valve is urged to a pump charge and line vent position illustrated in FIG. 3 by a helical return spring 168 located in a spring pocket 170 formed at one end of the bore which is closed by plug 172. A valve stop 174 extending axially in the spring pocket 170 terminates in an end surface 176 for engaging the end surface 178 of the valve element to establish the delivery position of the valve element. This occurs when the valve element is lifted by the force of a pulse of pressurized fuel from a high pressure pump through passage 179 that communicates with the bore 164 and the variable volume end chamber 184. The valve element 162 has an angular high pressure passage 180 leading from an axial inlet port 185 that aligns with the passage 179 and terminates in a radial passage leading to a circumferential discharge groove 186 that is blocked in the FIG. 3 position. When the valve element is lifted to its stop position shown in FIG. 3A, a cylindrical end collar 190 of the valve element clears the end wall of 192 of the spring pocket so that the annular feed port 186 hydraulically communicates via the spring pocket 170 to a fuel feed passage 194 that communicates with a fuel injection line that leads to a fuel injector nozzle such as that shown in FIG. 1.

In addition to the high pressure passage 180, the valve element 162 has an angled vent passage 196 drilled therein which, at one end, communicates with an axial port 198 leading to the spring pocket. The other end of the vent passage 196 connects to a peripheral discharge annulus 200 by way of radial bore 202. In the seated position shown in FIG. 3, the discharge annulus 200 communicates with a vent passage 206 in the rotor shank that communicates to a low pressure area such as the feed line for a transfer pump such as line 30 of the FIG. 1 embodiment.

The operation of the delivery and reverse flow venting valve of FIGS. 3, 3A and 3B is similar to that of the previous embodiment. When the high pressure fuel is pulsed by the high pressure pump, the valve element will be moved to the FIG. 3A position in which the high pressure fuel feed passage 180 is open to the spring chamber 170. A charge of pumped fuel will travel through the valve element and feed into passage 194 for connection to the injector nozzle for injecting a spray pattern of fuel into the combustion chamber. As soon as the charge leaves the valve element, the valve element is moved to the FIG. 3B position in which injection has ended and retraction has begun. As in the previous embodiment, a pressure wave will build at the nozzle for reflection at high velocity back toward the delivery valve. At the time of the arrival of this pressure wave, the valve has moved from the FIG. 3B position to the pump charge and line vent position of FIG. 3. The reflected pressure wave will enter the vent passage 196 in the valve element and will be vented to the vent line 206 and from the line 206 into a low pressure area within the hydraulic system of this delivery pump. Accordingly, the delivery valve provides new and improved reverse flow venting of pressure waves which will not be rereflected back toward the injector nozzle to cause secondary fuel injection with attendant increase in pollutants and poor engine performance.

Figure 4:
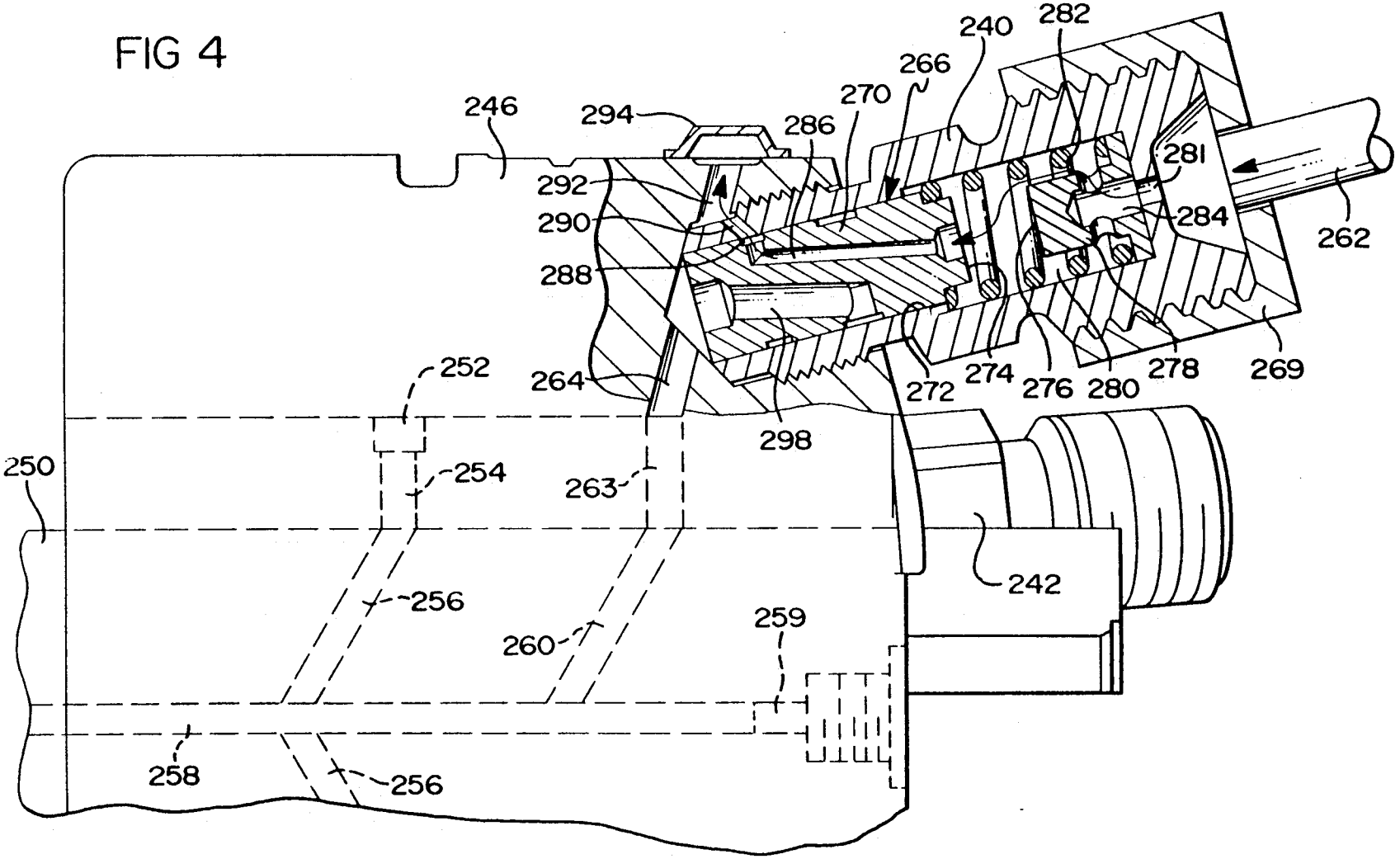
FIG. 4 is a view of a distributor pump for a fuel injected engine with portions in cross section illustrating another embodiment of the invention.

Turning now to the embodiment of FIG. 4, the fuel delivery and reverse flow venting valve of this invention can be installed in each of the fuel discharge fittings 240, 242 and others not shown which are threadedly connected into respective discharge bores of the hydraulic head 246 of a fuel distributor pump. These fittings connect to separate high pressure injector lines and their associated injector nozzles operatively mounted to inject fuel into the combustion chambers of a multi-cylindered internal combustion engine. As in the previously described embodiments, the fuel distributor pump includes an engine-driven rotor 250 that has cam operated pumping plungers which are supplied with fuel from a transfer pump which delivers fuel under low pressure to a charging annulus 252 and the radial passages 254 in the hydraulic head to feed charging passages 256 in the rotor that lead to the axial pumping chamber of a rotor pump. The pumping plungers, not illustrated, of the rotor pump are stroked inwardly as the rotor is turned to pump pressure fluid through the axial passage 258 blocked at its outer end by plug 259 which feeds into radial passage 260 in the rotor that, in one rotated position, communicates with the discharge fitting feed passage 263, 264 in the hydraulic head assembly for discharge fitting 240.

This fitting has a fuel delivery and reverse flow venting valve assembly 266 operatively mounted therein and is operatively connected to injection line 262 by nut 269. As in the previous embodiments, the injector line leads to an associated injector nozzle for injecting fuel to an internal combustion chamber of an engine. The valve assembly 266 includes a cylindrical valve element 270 linearly shiftable in discharge fitting bore 272 between the pump charging and line venting position shown and a fuel delivery position in which an outboard end 274 contacts an end 276 of a stop 278 operatively mounted in the chamber 280 for return spring 282 and for routing fuel to and from injection line 262 during engine operation. The stop has flow passage 284 therein which hydraulically connects the spring chamber 280 with an opening 281 in the end of the fitting that communicates with the injection line 268. In the seated position, a venting passage 286 in the valve element connects the spring chamber 280 to a venting annulus 288 adjacent to the inner end thereof. This annulus communicates with a passage 290 through the wall of the fitting which communicates with the entrance end 292 of the bore 264 in the head which leads to a manifold 294. From this manifold, fuel from line 268 is dumped to a low pressure area such as to the line 30 feeding into the transfer pump. As in the previous embodiments, the secondary pressure wave reflecting from an associated injector nozzle will be routed to low pressure where it is vented. With the secondary wave dissipated, a secondary injection of fuel into the combustion chamber is eliminated so that the engine will operate with optimized efficiency and with reduced hydrocarbons and smoke emissions.

As in the other embodiments, in the lifted position the valve element will be shifted against the stop 278 and the high pressure fuel feed passage open to the spring chamber 280 so that a pulse of high pressure fuel can be fed to the associated injector nozzle through delivery line 262 for engine operation.

While the invention has been described with reference to particular embodiments disclosed herein, it is not confined to the details set forth since it is apparent that various modifications can be made by those skilled in the art without departing from the invention set forth in the following claims:

We claim:

1. A fuel injection pump including high pressure pumping means and separate discharge fittings for supplying fuel from a source of liquified fuel to the combustion chambers of an internal combustion engine through fuel injector nozzles connected to fuel injection lines into which high pressure pulses of fuel are delivered from said high pressure pumping means through said fittings, the improvement comprising delivery valve assembly means operatively mounted in each of said fittings for feeding pulses of fuel into said fuel injector lines and for retracting fuel from said fuel injector lines, each of said delivery valve assembly means including a valve element operatively mounted for shifting movement in an associated fitting, an inlet passage in said fitting for receiving pulses of high pressure fuel from said high pressure pumping means, said delivery valve element having hydraulic passage means therein which hydraulically feeds said pulses to an associated high pressure line for delivery to its injector nozzle for subsequent feed into the associated combustion chamber, said valve assembly means having fluid passage means therein so that pressure waves of fuel reflecting from said fuel injector nozzle will be routed by said valve element to a low pressure area in said pump to eliminate secondary fuel injections.

2. A fuel injection pump including high pressure pumping means for supplying fuel from a fuel source to the combustion chambers of an internal combustion engine through fuel injector nozzles connected to fuel injection lines into which high pressure pulses of fuel are delivered from the high pressure pumping means, the improvement comprising a pump rotor having a bore therein, a valve element operatively mounted in said pump rotor bore, an inlet passage in said pump rotor for receiving the pulses of fuel from the pumping means, said valve element having first fluid passage means therein which, upon movement of said valve element from a first position to a second, shifted position, hydraulically transfers said pulses of fuel to a predetermined one of said fuel injection lines for delivery to its respective fuel injection nozzle, and having second fluid passage means therein which, upon movement of said valve element from said second position to said first position, hydraulically transfers pressure waves of fuel reflected from said predetermined injector nozzle to the fuel source.

3. A fuel injection pump including high pressure pumping means for supplying fuel from a fuel source to the combustion chambers of an internal combustion engine through fuel injector nozzles connected to fuel injection lines into which high pressure pulses of fuel are delivered from the high pressure pumping means, the improvement comprising a pump rotor having a bore therein, a valve element operatively mounted in said pump rotor bore, an inlet passage in said pump rotor for receiving the pulses of fuel from the pumping means, said valve element having a fluid passage means therein which, upon movement of said valve element from a first position to a second, shifted position, hydraulically transfers said pulses of fuel to a predetermined one of said fuel injection lines for delivery to its respective fuel injection nozzle, and said pump rotor having fluid venting passage means therein which, upon movement of said valve element from said second position to said first position, hydraulically transfers pressure waves of fuel reflected from said predetermined injector nozzle to the fuel source.

* * * * *